US006470921B1

(12) United States Patent
McGregor

(10) Patent No.: US 6,470,921 B1
(45) Date of Patent: Oct. 29, 2002

(54) ROTARY FLOW CONTROL DEVICE FOR BAG FILLING MACHINES

(75) Inventor: Harold McGregor, Owatonna, MN (US)

(73) Assignee: James McGregor, Lakeville, MN (US)

( * ) Notice: Subject to any disclaimer, the term of this patent is extended or adjusted under 35 U.S.C. 154(b) by 0 days.

(21) Appl. No.: 09/899,582

(22) Filed: Jul. 5, 2001

(51) Int. Cl.[7] ..... B65B 1/04

(52) U.S. Cl. ..... 141/12; 141/256; 141/71; 141/313; 222/413; 222/555

(58) Field of Search ..... 141/255, 256, 141/264, 286, 12, 11, 71, 69, 114, 313–317, 10; 239/683; 222/413, 555, 548

(56) References Cited

U.S. PATENT DOCUMENTS 3,045,871 A * 7/1962 Henrickson ..... 220/604
4,633,923 A * 1/1987 Hinzmann ..... 141/116
5,109,894 A * 5/1992 McGregor ..... 141/114

* cited by examiner

*Primary Examiner*—Steven O. Douglas
(74) *Attorney, Agent, or Firm*—Moore & Hansen

(57) ABSTRACT

A device for controlling the flow of a particulate material from a fill tube of a container filling system is herein disclosed. The rotary flow control device of the present invention includes a stationary plate having flow openings formed therethrough and a rotating plate having similar flow openings. The stationary plate is secured to a distal end of the fill tube such that particulate materials flow from the fill tube will pass through the flow openings of the stationary plate and become somewhat compacted. The rotating plate is adjacent the stationary plate and rotates with respect to the stationary plate so as to shear off masses of particulate materials extruded through the stationary plate in a controlled manner. Preferably the rotating plate will be coupled to the shaft of an auger where the shaft of the auger extends through the stationary plate.

24 Claims, 5 Drawing Sheets

F
40
17
17
12
13
20
18
42
26
22
27
44
24
2a
44
13
28
14
50
52
30
32
34
36
38
2a
B 50
52
14
13
54
12

24
44
28
3a
52
58
62
56
60
13
54
12
14
62
58
56
50
60
3a

ROTARY FLOW CONTROL DEVICE FOR BAG FILLING MACHINES

FIELD OF THE INVENTION

The present invention relates generally to mechanisms for filling bags and particularly to a rotary flow control device for an auger bag filling system designed for depositing a predetermined charge of particulate materials into a bag.

BACKGROUND OF THE INVENTION

Rotary feed auger systems for dispensing particulate materials into containers are well known in the art. These systems are very useful for rapidly depositing a gross charge of particulate material within a container. However, a common shortcoming shared by rotary feed auger systems is that they have difficulty in filling containers to within a specific low tolerance. This stems from the fact that the open end of a rotary feed auger system does not adequately contain particulate material therein when the auger is not operating. Therefore, quantities of particulate material may fall from within the fill tubes of these rotary feed auger systems before or after the rotary feed auger system has dispensed a presumably accurate charge quantity of particulate material into the container. Such errors are not as critical when the containers being filled are relatively large. However, when the containers being filled are of a small to moderate size, it is often necessary to include a separate top-off station with the rotary feed auger system to insure that the container has the desired charge weight of particulate material deposited therein.

Accordingly, it is an object of the present invention to provide a structure that will increase the accuracy and precision with which a rotary feed auger system dispenses particulate materials into a container.

SUMMARY OF THE INVENTION

The objects of the present invention are met by a rotary flow control device that comprises a stationary plate and a rotary plate. The stationary plate of the present invention has a plurality of flow openings formed therethrough and coupled to the discharge end of a fill tube of the container filling system so as to create a flow obstruction of sufficient magnitude to compact a particulate material flowing through the fill tube. The rotary plate of the present invention is operatively disposed adjacent the stationary plate and also has a plurality of flow openings formed therethrough. The rotary plate is constructed and arranged to rotate with respect to the stationary plate in such a manner that the flow openings formed through the rotary plate periodically come into alignment with the flow openings of the stationary plate, thereby allowing the compacted particulate material to flow through the respective flow openings. The rotation of the rotary plate with respect to the stationary plate acts to shear off portions or masses of the particulate material that has flowed or has been extruded or conveyed through the respective flow openings of the stationary and rotary plates.

Preferably the rotary flow control device with which the present invention is utilized will also include an auger that is disposed within the fill tube of the container filling system for conveying particulate materials therethrough. Where this is the case, the shaft o the auger will be made to pass through the stationary plate so that the rotary plate may be coupled thereto. Consequently, in this preferred embodiment, the rotary plate will be constrained to rotate with the shaft of the auger. However, where an auger is used, it is also preferred to space the flights of the auger a predetermined distance from the stationary plate. In one embodiment, this distance is approximately two inches.

The flow openings formed through the stationary plate are defined by a plurality of ribs that have a tapered cross section such that the flow openings are narrower at an exit side than they are at an entrance side. This arrangement increases the compacting ability of the stationary plate. Preferably the side surfaces of the plurality of ribs that define the flow openings are tapered at approximately 15 degrees from an axis defined by the central axis of the fill tube.

In order to enhance the flow of particulate materials from a supply hopper and through a fill tube coupled to an outlet thereof, it is often desirable to couple the supply hopper to a vibrating mechanism for vibrating the supply hopper to at least partially fluidize a quantity of particulate material disposed therein. Similarly, a hopper may be provided with a wiper assembly comprising a wiper constructed and arranged to move along an inner surface of the supply hopper so as to prevent the adhesion of a particulate material contained within the supply hopper to the inner surface of the supply hopper.

Another feature that improves the flow of particulate materials through an auger fed container filling system incorporates an interrupted screw auger comprising a shaft having affixed thereto an upper section of flights that is disposed entirely within the supply hopper and an lower section of flights that is disposed entirely within the fill tube. The upper and lower sections of flights are beneficially separated by a space of predetermined length generally located at the juncture between the fill tube and the supply hopper. Where the interrupted screw auger is utilized it is often preferred to utilize an auger having an upper section of flights with a diameter that is larger than the diameter of the lower section of flights thereof. The upper section of flights, regardless of its diameter, is ideally positioned within the supply hopper to act upon the particulate material contained therein so as to move the particulate material toward the fill tube coupled to the supply hopper. It is to be understood that the present invention may be used with any combination of the aforementioned vibrating mechanism, wiper assembly, and interrupted screw auger, or even without.

The present invention may alternatively be stated in terms of an auger feed container filling system comprising a supply hopper having an inlet and an outlet, a fill tube having an upper end and a lower end, with the upper end of the fill tube being coupled to the outlet of the supply hopper, an auger comprising a shaft and at least one section of flights disposed within the fill tube, and a rotary flow control mechanism coupled to the lower end of the fill tube. The rotary flow control mechanism itself comprises a stationary plate that is coupled fixedly to the lower end of the fill tube and a rotary plate coupled to the shaft of the auger as it extends through a central bore in the stationary plate such that the rotary plate is positioned adjacent the stationary plate opposite the lower end of the fill tube. The stationary plate has a plurality of flow openings and a central bore formed therethrough. The flow openings of the stationary plate are bounded by and defined at least in part by a plurality of ribs. The rotary plate also has formed therethrough a plurality of fill openings, with the flow openings being bounded by and defined at least in part by a plurality of ribs. The flow openings of the rotary plate and the stationary plate are constructed and arranged such that as the rotary plate rotates in relation to the stationary plate, the flow openings of the respective plates will at least partially become aligned with one another so as to allow the flow of a particulate material being conveyed by the auger through the respective plates of the rotary flow control device. As the rotary plate continues to rotate with respect to the stationary plate, the ribs defining the flow openings of the rotary plate will act to shear off particulate material that has flowed through the at least partially aligned flow openings of the stationary and rotary plates. The action of the auger against the rotary flow control device is such that the particulate material is compacted to a degree that limits the incidence of particulate material falling from the fill tube when the auger is not operational. A bag support and handling mechanism is provided to support a bag adjacent the rotary flow control device for filling.

The auger utilized with the auger fee container filling apparatus may be one of any configuration but in one preferred embodiment, the auger will be an interrupted screw auger comprising a shaft that extends through the supply hopper and fill tube, an upper section of flights disposed entirely within the supply hopper, and a lower section of flights disposed entirely within the fill tube. The at least one section of flights of the auger disposed within the fill tube is spaced away from the rotary flow control device by a predetermined distance that in one embodiment is approximately 2 inches.

The edge profiles of the flow openings in the stationary plate are preferably at least partially tapered such that the entry side of the flow openings is larger than the exit side of the flow opening. The taper imparted to the edge profiles of the flow openings of the stationary plate is sufficient to at least partially compact a particulate material flowing through the at least partially aligned flow openings of the stationary and rotary plates. In one embodiment, the taper of the edge profiles of the flow openings of the stationary plate is approximately 15 degrees from an axis defined by the central axis of the fill tube.

Where the rotary flow control device is to be used with extremely flowable particulate materials, the device may comprise a stationary plate having a plurality of flow openings formed therethrough with the flow openings being separated by a plurality of ribs. The stationary plate is coupled to a discharge end of a fill tube of a container filling system so as to create a flow obstruction of sufficient magnitude to at least partially compact a particulate material flowing through the fill tube. A plurality of baffles is affixed to an upper surface of the ribs of the stationary plate. The baffles simultaneously compact and direct the particulate materials into the flow openings of the stationary plate. A rotary plate is coupled to the container filling system and disposed adjacent the stationary plate. The rotary plate also has a plurality of flow openings formed therethrough and is constructed and arranged to rotate with respect to the stationary plate in such a manner that the flow openings formed through the rotary plate periodically come into alignment with the flow openings of the stationary plate. This period alignment allows the compacted particulate material to flow through the respective flow openings so that the rotation of the rotary plate may also act to shear off portions of the particulate material that has flowed through the respective flow openings of the stationary and rotary plates. This embodiment may or may not comprise an auger of standard or interrupted screw configuration. Where an auger is utilized with the fill tube, the shaft of the auger will extend through the stationary plate so that the rotary plate may be coupled to the end thereof. Another feature of this embodiment is that the flow openings of the rotary plate may be positioned out of alignment with the flow openings of the stationary plate when the auger is stationary so as to completely close off the lower end of the fill tube. In this manner, no particulate material will be able to exit the fill tube when the flow openings of the respective plates are so misaligned.

Yet another rotary flow control device for a container filling system comprises a stationary plate that has a plurality of flow openings formed therethrough, with the stationary plate being coupled to the discharge end of a fill tube of the container filling system so as to create a flow obstruction of sufficient magnitude to compact a particulate material flowing through the fill tube and a rotary plate rotatably coupled to the stationary plate adjacent the stationary plate. The rotary plate also has a plurality of flow openings formed therethrough and is constructed and arranged to rotate with respect to the stationary plate in such a manner that the flow openings formed through the rotary plate periodically come into alignment with the flow openings of the stationary plate, thereby allowing the compacted particulate material to flow through the respective flow openings. The rotation of the rotary plate also acts to shear off portions of the particulate material that has flowed through the respective flow openings of the stationary and rotary plates. In the absence of an auger shaft, the container filling system may further comprise an independent drive mechanism that is operatively coupled to the container filling system so as to rotate the rotary plate with respect to the stationary plate.

These and other objectives and advantages of the invention will appear more fully from the following description, made in conjunction with the accompanying drawings wherein like reference characters refer to the same or similar parts throughout the several views.

DETAILED DESCRIPTION OF THE INVENTION

The present invention represents an improvement over known rotary feed auger systems and comprising a rotary flow control device 14. The present invention is preferably incorporated into an rotary feed auger bag filling machine 10 of the type disclosed in U.S. Pat. Nos. 4,944,334 and 5,042,539 to Harold R. McGregor, hereby incorporated by reference. However, it is to be understood that the present invention may be incorporated into separate and distinct bag or other container filling mechanisms and particularly, may be adapted for use with any type of auger feed container filling system or mechanism. As used herein, the term "bag filling" shall be interpreted to include the filling of any type of bag, box, or other container for containing and conserving particulate materials.

Figure 1:
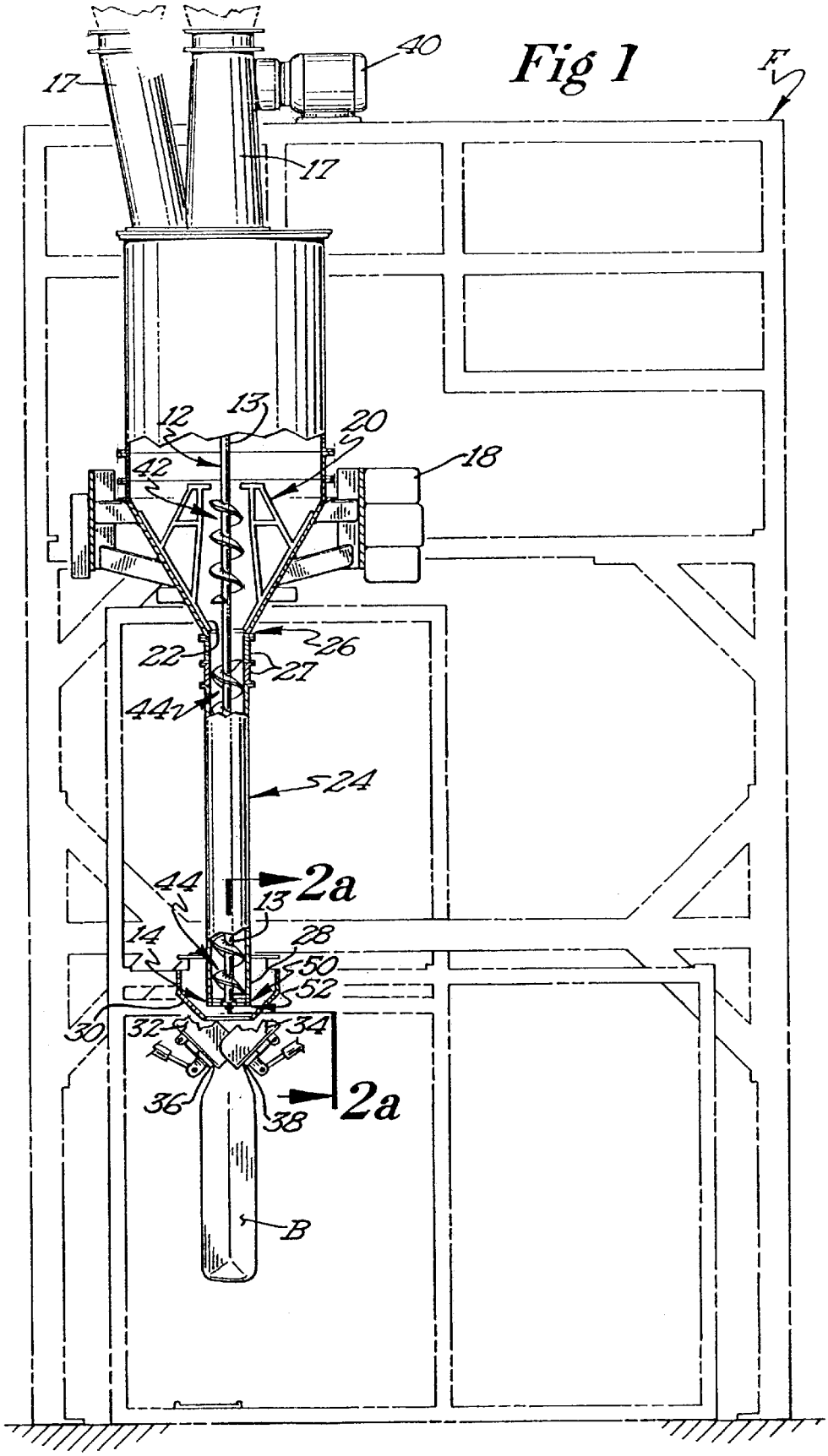
FIG. 1 is a cross-sectional view of an auger bag filling system having an interrupted screw and a rotary flow control device of the present invention.

An auger tube bag filling machine 10 constructed according to the present invention is illustrated in cross section in FIG. 1. The bag filling machine 10 comprises an inverted cone shaped hopper 16 in which particulate material that is to be placed in a bag B is temporarily stored prior to being dispensed into the bag B. The hopper 16 has one or more inlets 18 through which particulate materials are supplied from a bulk storage unit, not shown. The hopper 16 is supported upon a framework F. Note that the framework F illustrated in FIG. 1 is of a general size and shape suitable to support not only the hopper 16, but the remaining components of the bag filling machine 10, as well. The present invention is therefore not to be considered limited to the type of framework F shown. Accordingly, any type of structure capable of supporting the various components in any arrangement that permits the useful operation of a bag filling machine 10 is expressly contemplated.

The hopper 16 is preferably mounted within or otherwise coupled to a vibrator 18. Vibrator 18 acts to shake the hopper 16 in such a manner that the particulate materials contained therein remain relatively fluidized. Not only does the vibration improve the flow of the particulate materials through fluidization, but the vibration acts to prevent the formation of air pockets and also prevents the particulate materials from sticking to the hopper 16. A preferred embodiment of the hopper 16 also comprises a rotary wiper assembly 20. The rotary wiper assembly 20 comprises a wiper 22 that is moved against and around the frustoconical lower section of the hopper 16. The wiper 22 acts to prevent the particulate materials from sticking to the sides of the hopper 16.

A fill tube 24 is coupled to an outlet 26 of the hopper 16. The outlet 26 of the hopper 16 preferably comprises an elastic fitting or coupling(s) 27 that isolate the fill tube 24 from the hopper 16 so that vibrations imparted to the hopper 16 by the vibrator 18 do not affect the fill tube 24. The fill tube 24 extends downwardly from the hopper 16 and has a distal end 28 that is disposed adjacent a bag filling spout 30. Bag filling spout 30 is of any useful type and will typically comprise a pair of rotatable and opposable clam shell halves 32 and 34 of the type disclosed in U.S. Pat. No. 5,768,863, to Harold R. McGregor, hereby incorporated by reference. Preferably the spout clamshell halves 32, 34 will have secured thereto respective bag clamps 36, 38 for securely grasping and holding a bag B on the spout 30 for filling. Additional mechanisms for supplying bags B to the spout 20, for controlling the bag B on the spout, and for sealing the bags B may be provided or omitted as needed.

Fill tube 24 has disposed therein an interrupted screw auger 12. The auger 12 has a shaft 13 that extends from adjacent the distal end 28 of the fill tube 30, through the fill tube 30 and hopper 16, to a position above the hopper 16 where the shaft is coupled to a motor 40 or other means of motive power such as a transmission gear box or the like. The shaft 13 of the auger 12 has at least two separate sections of flights 42, 44 wound about the shaft 13. The upper section of flights or overflight 42 is disposed within the hopper 16 adjacent the outlet of the hopper. The exact distance that the upper section of flights 42 of the auger 14 is spaced away from the outlet of the hopper 16 is variable and relates to the fluidic nature of the particulate materials contained in the hopper and to the pitch and diameter of the flights 42 themselves. The purpose of the upper section of flights 42 is to convey particulate materials directly from the stored volume within the hopper 16 into the fill tube 30. While the absence of a skirting structure around the upper section of flights 42 of the auger 12 prevents the efficient conveyance of particulate materials into the fill tube 24, the conveying action of the upper section of flights 42 acts to compact and direct the particulate materials within the fill tube much more efficiently than does gravity alone. This improved efficiency is independent of the action of the vibrator 18 and wiper assembly 20. As a result of the upper section of flights' 42 action, the fill tube 24 containing the lower section of flights 44 is filled more completely and contains fewer air pockets that can lead to the inaccurate filling of bags. While it is preferred that the upper section of flights 42 be larger in diameter than the lower section of flights 44, the exact diameter and pitch of the sections of flights 42, 44 is dependent on the nature of the conveyed materials and will therefore vary with each distinct application of the present invention. Note also that the rotary flow control device 14 of the present invention may be used with any type of continuous or interrupted screw auger having variable or constant pitch flights.

As can be seen in FIG. 1, the upper and lower flight sections, 42 and 44, are separated by a space that is located at the outlet 26 of the hopper 16. In this manner, particulate material moved by the upper flight section 42 and particulate materials flowing downward under the influence of gravity and/or the wiper assembly 20 and vibrator 18 will commingle as the particulate material enters the fill tube 24. The dimensions of the space between upper and lower flight sections 42, 44 will vary depending on the dimensions of the flight sections 42 and 44, the diameter of the fill tube 24 and outlet 26 of the hopper 16, and the flow characteristics of the particulate material being handled. However, in general, the distance will be approximately six (6) inches.

Particulate materials that have entered the fill tube 24, either under the influence of gravity, the upper section of flights 42, the wiper 22, or vibrating hopper 16, are addressed by the lower section of flights 44 disposed within the fill tube 24 and conveyed downward to the distal end 28 of the fill tube 24. The particulate material is then discharged from the distal end 28 of the fill tube 24 into bag B that is supported upon spout 30. In a preferred implementation of the present invention, a gross approximation of a predetermined charge quantity of particulate material may be dispensed into a bag B by rotating the auger 12 a specific number of times at a first, relatively fast fill rate. Once the approximate charge quantity has been deposited in the bag B, the auger 12 will begin to rotate at a section, relatively slower rate to add a final amount of particulate material calculated to top off the bag B and bring the quantity of particulate materials in the bag B up to the predetermined charge quantity. The number of rotations that the auger 12 must make in order to convey a predetermined charge quantity of particulate material is dependent upon the size and configuration of the lower section of flights 44 and the fill tube 24 and is typically first calculated and later verified experimentally to ensure that the auger does indeed provide the predetermined charge quantity of particulate materials to the bag B. As indicated above however, in a standard auger fill system, there is nothing to prevent particulate material in the fill tube from falling into the bag B when the auger 12 is stationary. Therefore, it is preferable to provide a rotary flow control mechanism 14 as illustrated in the Figures.

Another method of filling bags B utilizes a loss-in-weight metering system that measures the quantity of material lost from the auger bag filling system into a bag B to determine when a predetermined charge weight of particulate materials has been added to a bag B. In a loss-in-weight system, the hopper 16, fill tube 24, auger 12, and rotary flow control device 14 are suspended from a framework that includes a plurality of load cells that continuously monitor the weight of these components as well as the weight of the particulate material present therein. The spout 30 and bag B are supported independently of the aforementioned components of the bag filling machine 10. As the auger 12 rotates, thereby conveying particulate material from the hopper 16 to the bag B, the load cells monitor the amount of particulate material that has left the hopper-fill tube of the bag filling machine 10. When the weight of the particulate material lost from the hopper-fill tube is the same as the desired charge weight, a controller stops the auger 12 and the bag B is closed, sealed, and another, empty bag is addressed to the spout 30. The loss-in-weight metering system also suffers from the problem of a lack of control of the particulate material within the distal end of the fill tube 24.

The rotary flow control mechanism 14 acts to prevent the unwanted flow of particulate materials from the fill tube 24 when the auger 12 is not in operation. The flow control mechanism 14 comprises an upper stationary plate 50 and a lower, rotating plate 52. The upper stationary plate 50 is removably secured in a known manner to the distal end 28 of the fill tube 24. The shaft 13 of the auger 12 passes through a bore 54 formed in the center of the stationary plate 50. The rotary plate 52 is removably secured to the end of the shaft 13 of auger 12 adjacent to the stationary plate 50. The rotating plate 52 rotates with the auger 12 and with respect to the stationary plate 50.

The lower section of flights 44 ends a predetermined distance above the stationary plate 50 that is defined by the flow characteristics of the particulate material being handled by the bag filling machine 10. Where the particulate material is easily compactible, the space between the lower section of flights 44 and the stationary plate 50 will be relatively smaller and where the particulate material is relatively uncompactible, the space will be relatively larger. In a preferred embodiment of the present invention configured for handling particulate materials such as wheat flour, the space between the lower section of flights 44 and the stationary plate 50 is approximately two (2) inches.

Figures 2A, 2B:
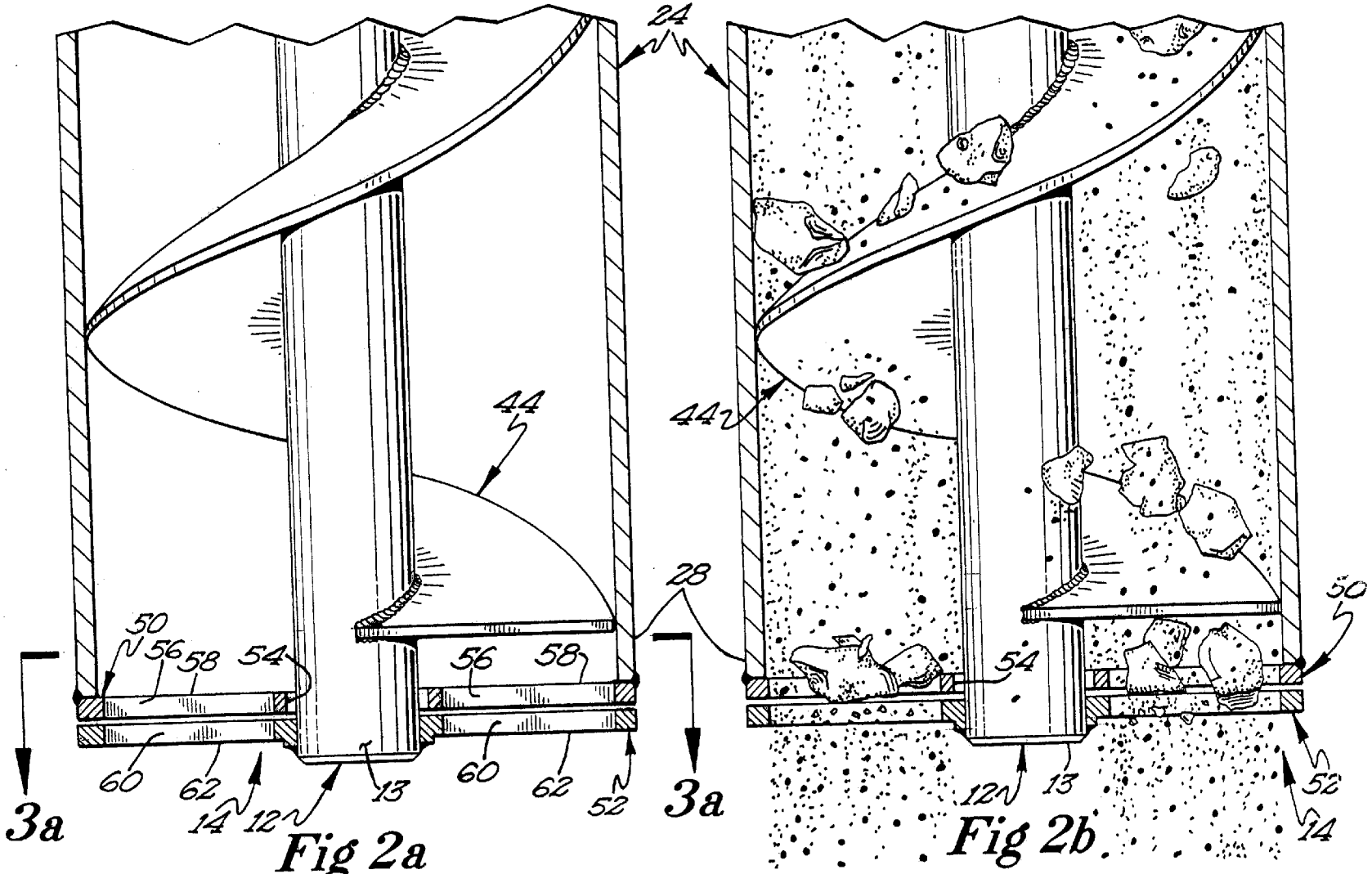
FIG. 2*a* is a close-up, cross-sectional view of the bottom end of an auger and fill tube of an auger bag filling system illustrating the rotary flow control device of the present invention attached to the vertical auger shaft.
FIG. 2*b* is a close-up, cross-sectional view of the vertical auger and rotary flow control device of FIG. 2*a* further illustrating how the particulate material conveyed by the auger and fill tube of an auger bag filling system is extruded through the rotary flow control device.

In FIGS. 2*a* and 2*b* the rotating plate 52 is illustrated as being slightly spaced apart from the stationary plate 52. It is to be understood that the rotating plate 52 may be in substantially full facial contact with each other or spaced apart from the stationary plate 50 by as much as one half of one inch (½") or as far as the particulate material being conveyed requires. However, it is preferred that the rotating plate 52 be slightly separated from the stationary plate 50 so that particulate materials will not become trapped between the plates 50, 52. And while the plates 50 may be fashioned of untreated ferrous or nonferrous materials, it is preferred to coat the plates 50, 52 with a slippery material such as Teflon or ultra high molecular weight plastics.

Figure 4:
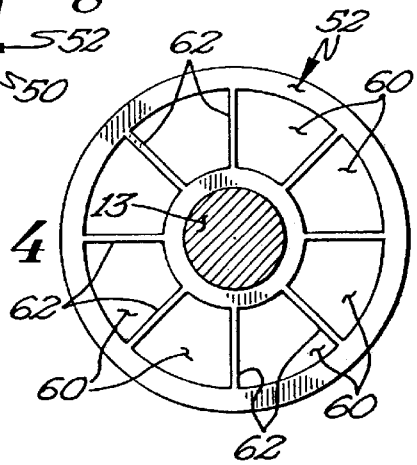
FIG. 4 is a top plan view of one embodiment of the rotating plate of the rotary flow control device of the present invention.
Figure 5:
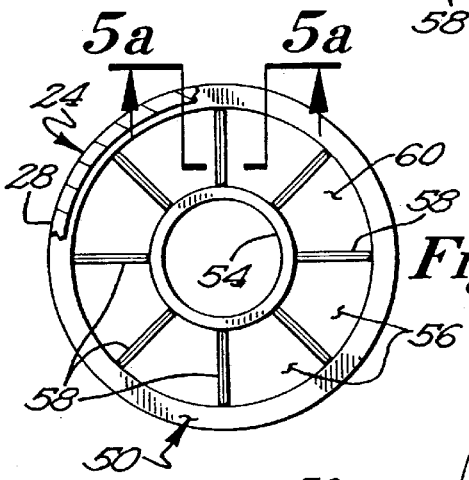
FIG. 5 is a top plan view of one embodiment of the stationary plate of the rotary flow control device of the present invention.

A preferred embodiment of the plates 50, 52 is illustrated in FIGS. 4 and 5. The stationary plate illustrated in FIG. 5 has a bore 54 in its center to allow the shaft 13 of the auger 12 to pass therethrough. The plate 50 is attached at its perimeter to the fill tube 24 in such as manner that it may be easily removed. Flow openings 56 are formed through the plate 50 and allow particulate materials to pass therethrough. Ribs 58 separate and define flow openings 56 and support the center portion of the plate 50. Ribs 58 and the remainder of the plate 50 create a low level flow obstruction that acts to compact the particulate materials being conveyed through the fill tube 24 by the auger 12. The compaction of the particulate material results in a somewhat denser material that can better support itself in the smaller flow openings 56, thereby reducing the problem of particulate materials falling from the fill tube 24 while the auger 12 is not in operation. The space between the lower section of flights 44 on the auger 12 and the stationary plate 50 becomes, as a result of the compacting caused by the plate 50, substantially full of the particulate material being conveyed. Subsequent conveying action by the auger 12 forces the particulate material from the fill tube 24 though the flow openings 56 in an action reminiscent of extrusion. The extruded particulate material, as illustrated in FIG. 2*b*, will tend to support itself below the stationary plate 50 and not fall into the spout 30 and bag B.

The rotating plate 52, illustrated in FIG. 4 also has a plurality of flow openings 60 that are defined by ribs 62. Central portion 64 of plate 52 is secured to the end of the auger shaft 13 as by a bolt or screw so the rotating plate 52 is constrained to rotated with the shaft 13 of the auger 12. As the rotating plate 52 rotates with respect to the stationary plate 50, the flow openings 60 of the rotating plate will come into alignment with the flow openings 56 of the stationary plate 50, thereby allowing the particulate materials to be conveyed or extruded from the fill tube 24 through flow openings 56 and 60 of the respective plates 50, 52. As the rotating plate 52 continues its rotation, the ribs 62 of the rotating plate shear off the extruded particulate material as illustrated in FIG. 2*b* so that it will drop off into the spout 30 and hence, the bag B.

Figure 6:
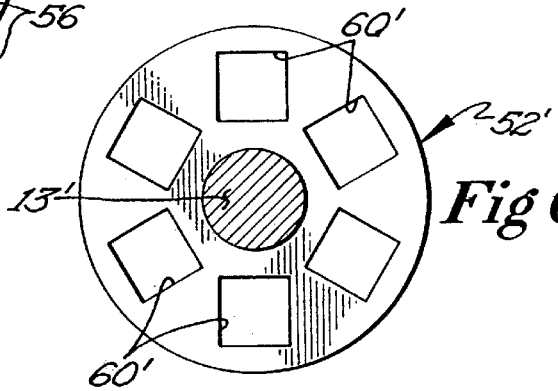
FIG. 6 is an alternate embodiment of the rotating grid plate of the rotary control device of the present invention.
Figure 7:
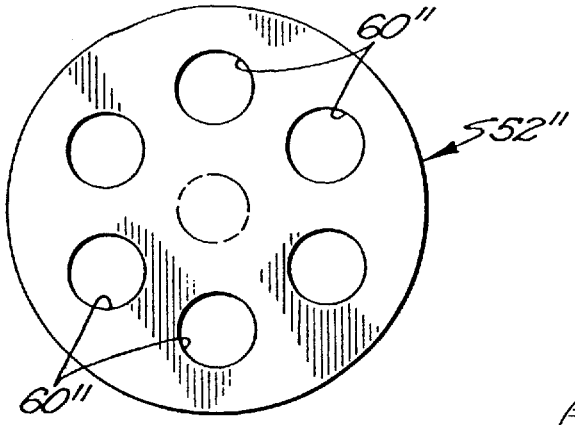
FIG. 7 is yet another alternate embodiment of the rotating plate of the rotary flow control device of the present invention.

As can be appreciated, the general shape and size of the plates 50, 52 will be tied to the size and shape of the fill tube 24 of the bag filling machine 10. In general however, the plates 50, 52 are circular in cross-section. The flow openings 56, 60 formed through the plates 50, 52, respectively, may have myriad sizes and shapes that all depend upon the flow characteristics of the particulate material and the size and arrangement of the auger 12 and fill tube 24. FIGS. 4 and 5 illustrate flow openings 56, 60 having the shape of truncated sectors of a circle and relatively thin ribs 58, 62. FIG. 6 illustrates a rotating plate 52 having a plurality of square flow openings 62 formed therethrough. Likewise, FIG. 7 illustrates a rotating plate 52 having a plurality of circular flow openings 62 formed therethrough. FIGS. 8–11 illustrate flow openings having the shape of a truncated sector of a circle wherein the stationary plate 50 has a plurality of baffles covering alternating flow openings 56.

Figure 5A:
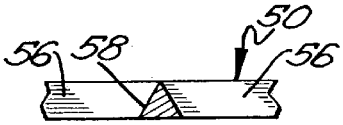
FIG. 5*a* is a cross section view of a rib of the stationary plate of the rotary flow control device taken along cutting lines 5*a*—5*a* in FIG. 5.

The resistance to flow created by the stationary plate 50 of the rotary flow control mechanism 14 is directly related to the total area of the fill tube 24 that is blocked and the nature of the blockage. For instance, where very flowable particulate materials are being handled, it may be desirable to increase the space between the lower section of flights 44 and the stationary plate 50 and to also increase the width of the ribs 58 in relation to the size of the flow openings 56. This arrangement will increased the resistance to flow and permit a larger volume of the particulate material to become compacted. The resistance to flow may also be modified as illustrated in FIG. 5*a*. In FIG. 5*a* a rib 58 having a tapered cross section is illustrated. The tapered cross section of the rib 58 in FIG. 5*a* prevents permanent accumulations of the particulate material from forming above the plate 50 and also acts to compact or wedge the particulate materials as they are conveyed or extruded through the flow openings 56. While the rib 58 illustrated in FIG. 5*a* has a taper of approximately 15° on each side thereof, this taper can vary widely depending upon the nature of the material being conveyed. One particular alteration to the dimension of the stationary plate 50 that can be used in conjunction with tapered ribs 58 to vary the amount of compaction of the particulate material is the thickness of the plate 50. A thicker plate 50 allows for greater compaction as the particulate material is passed through the flow openings 56 between tapered ribs 58. This additional compaction augments the particulate material's cohesion and further reduces the likelihood that the materials will fall from the fill tube 24 while the auger 12 is not in operation.

Figure 3A:
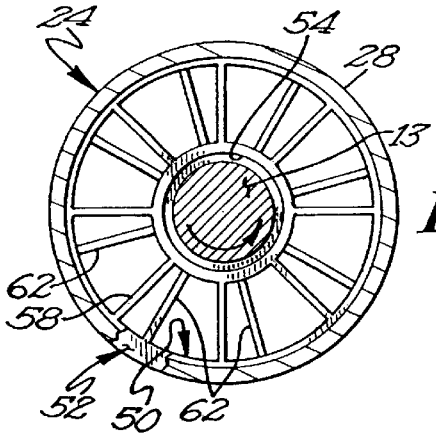
FIGS. 3*a*–3*c* illustrate how the rotating plate of the rotary flow control device moves with respect to the stationary plate of the rotary flow control device as the auger shaft rotates.
Figure 3B:
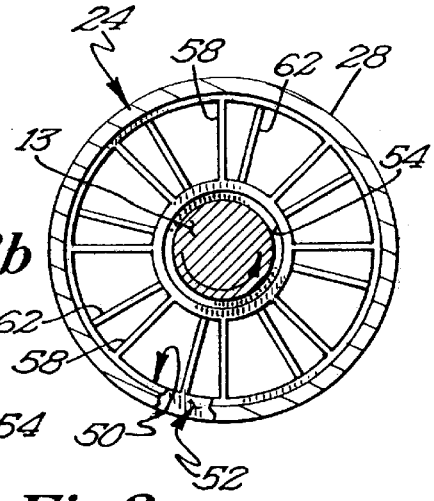
Figure 3C:
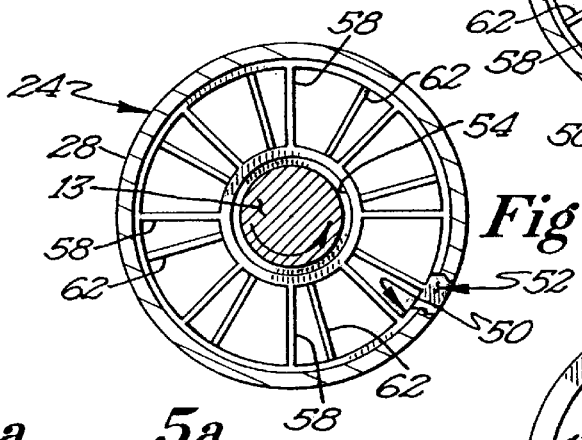
Figure 8:
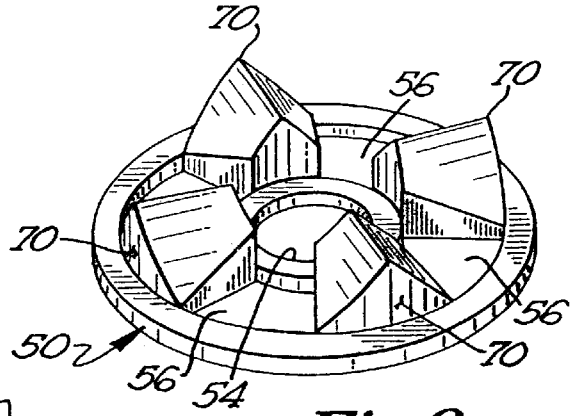
FIG. 8 is a perspective view of a stationary plate of an alternate embodiment of the rotary flow control device of the present invention that incorporates baffles.
Figure 9:
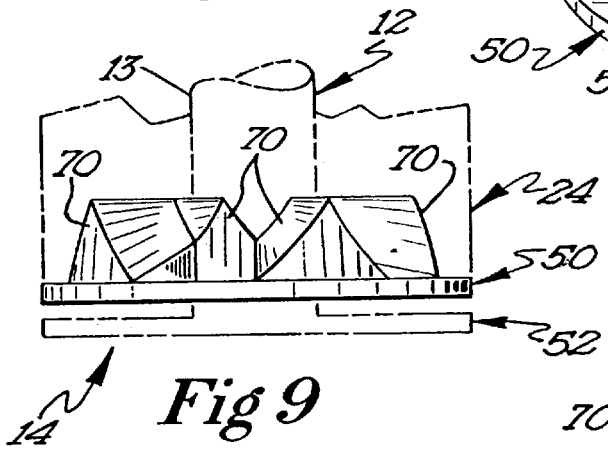
FIG. 9 is a cut away view of the stationary plate illustrated in FIG. 8 installed on an auger and fill tube of an auger bag filling machine.
Figure 10:
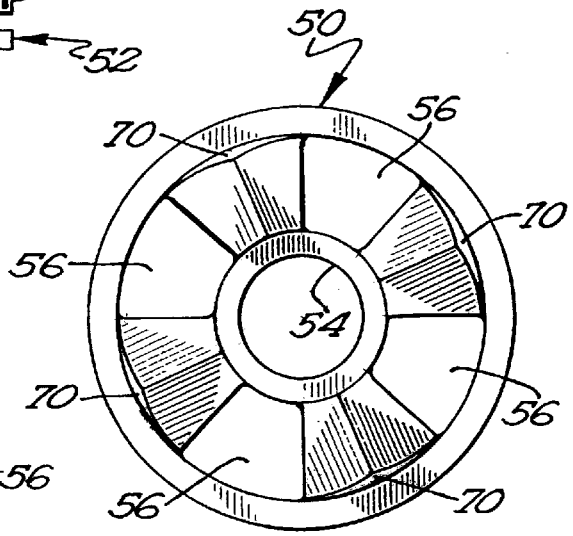
FIG. 10 is a top plan view of the stationary plate illustrated in FIG. 8.
Figure 11:
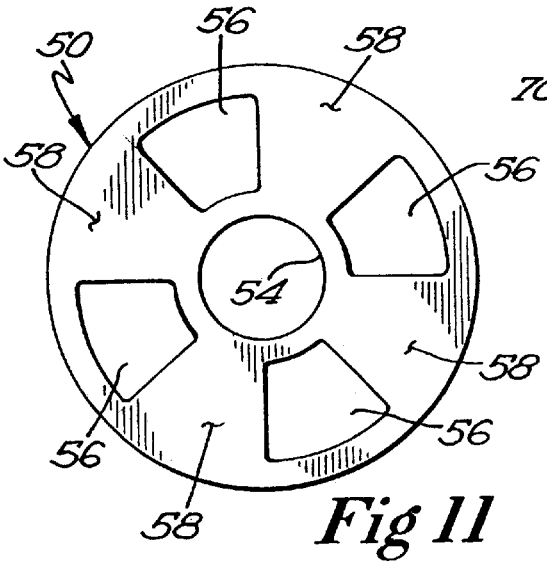
FIG. 11 is a top plan view of a rotating plate constructed and arranged for use with the stationary plate illustrated in FIG. 8.
Figure 12:
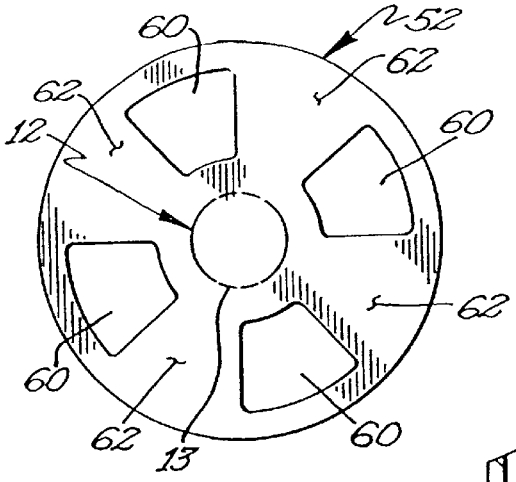
FIG. 12 is a bottom view of the stationary plate illustrated in FIG. 8; and, FIG. 13 illustrated an alternate embodiment of the rotary flow control device that employs an independent drive mechanism to rotate the rotating plate thereof.

FIGS. 3*a*–3*c* illustrate the stationary and rotating plates 50, 52 in operation. As can be seen, the stationary plate 50 remains fixed with respect to the fill tube 24 while the rotating plate 52 rotates on the auger shaft 13 as indicated by the direction arrow in the Figures. In FIG. 2*b*, the action of the auger 12 can be seen to extrude particulate material through the flow openings 56 and 60 of the plates 50, 52. The rotation of the auger shaft 13 causes the ribs 62 of the rotating plate 52 to shear off the particulate material that extends into the path of the ribs 62 of the rotating plate 52. While the auger 12 is in operation, the conveying or extruding action of the auger 12 upon the particulate material would be sufficient to force the particulate materials from the fill tube 24. However, when the auger 12 is not in operation, because of the augmented cohesion lent to the particulate materials by its compacted state, the particulate materials will not fall from the fill tube 24, rather, the shearing action of the rotating plate 52 is required to cause the particulate materials to drop into the spout 30 of the bag filling machine 10.

Where particularly flowable materials are handled by the bag filling machine 10, it is desirable to utilize a flow control mechanism 14 such as that illustrated in FIGS. 8–12. FIG. 8 illustrates a stationary plate 50 having a similar structure to the plate 50 illustrated in FIG. 5 with the added structure of a baffle 70 being secured to the relatively wide ribs 58 between flow openings 56. The baffles 70 act to obstruct the flow of the otherwise highly flowable materials with which the embodiment illustrated in FIGS. 8–10 is typically utilized. The baffles 70 extend upwardly from the stationary plate 50 into the space between the lower section of flights 44 and the stationary plate 50. Preferably the flights 44 will direct the particulate materials against the baffles 70, thereby compacting the particulate materials and simultaneously directing them into the flow openings 56 of the stationary plate 50. Because many particulate materials such as semolina or other granular materials are not typically sufficiently compactible, it is preferred to arrange the relatively large ribs 62 of the rotating plate 52 of FIG. 11 such that the ribs 62 will be aligned with the flow openings 56 of the stationary plate 50 when the auger 12 is not in operation. In this manner, the ribs 62 will block substantially all flow of particulate materials from the fill tube 24 when the auger 12 is not in operation. The closing of the flow openings 56 by the ribs 62 may be adapted for use without the need for baffles 70 as illustrated.

Figure 13:
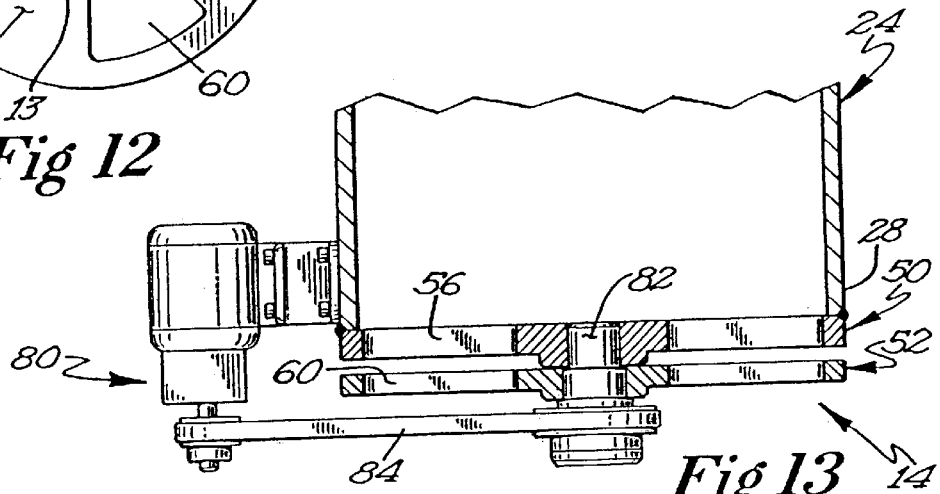

In certain circumstances, the rotary flow control device may be used in a fill tube 24 also known as a slip tube that does not have an auger 12 disposed therein. In this application, the rotary flow control device will preferably be rotatably coupled to the stationary plate as illustrated in FIG. 13. In the embodiment of the rotary flow control device 14 illustrated in FIG. 13, the rotating plate 52 is coupled as by shaft 82 to the stationary plate. A drive mechanism 80 provides motive power to the rotating plate 52 via belt or chain 84. The drive mechanism may include sensors that indicate the position of the rotating plate 52 with respect to the stationary plate so that embodiments of the rotary flow control device similar to that illustrated in FIGS. 8–12 may be operated as described above. Note that the drive mechanism 80 may be any type of motor device suitably adapted for controlling the rotating plate 52. An application to which the embodiment of the present invention is particularly well-adapted is disclosed in U.S. patent application Ser. No. 09/771,758 to James R. McGregor et al., filed on Jan. 29, 2001 and entitled Fill Tube Control Mechanism, hereby incorporated by reference.

The invention described above may be embodied in other forms without departing from the spirit or essential characteristics thereof. The embodiments disclosed in this application are to be considered in all respects as illustrative and not restrictive. The scope of the invention is indicated by the appended claims rather than by the foregoing description and all changes which come within the meaning and range of equivalency of the claims are intended to be embraced therein.

What is claimed is:

1. A rotary flow control device for a container filling system comprising:

a stationary plate having a plurality of flow openings formed therethrough, the stationary plate being coupled to a discharge end of a fill tube of the container filling system so as to create a flow obstruction of sufficient magnitude to compact a particulate material flowing through the fill tube; and, a rotary plate coupled to and rotates with the shaft of an auger disposed within the fill tube of the container filling system, the rotary plate being disposed adjacent the stationary plate and having of flow openings formed therethrough, the rotary plate being constructed and arranged to rotate with respect to the stationary plate in such a manner that the flow openings formed through the rotary plate periodically come into alignment with the flow openings of the stationary plate thereby allowing the compacted particulate material to flow through the respective flow openings, the rotation of the rotary plate acting to shear off portions of the particulate material that has flowed through the respective flow openings of the stationary and rotary plates.

2. The rotary flow control device for a container filling system of claim 1 wherein the flow openings of the stationary plate are defined by a plurality of ribs and wherein the ribs have a tapered cross section such that the flow openings are narrower at an exit side than they are at an entrance side.

3. The rotary flow control device for a container filling system of claim 2 wherein the side surfaces of the plurality of ribs that define the flow openings taper at approximately 15 degrees from an axis defined by the central axis of the fill tube.

4. The rotary flow control device for a container filling system of claim 1 wherein the flights of the auger end a predetermined distance from the stationary plate.

5. The rotary flow control device for a container filling system of claim 1 wherein the flights of the auger end approximately two inches from the stationary plate.

6. The rotary flow control device for a container filling system of claim 1 wherein the fill tube is coupled at an upper end to a supply hopper, the supply hopper having coupled thereto a vibrating mechanism for vibrating the supply hopper to at least partially fluidize a quantity of particulate material disposed therein.

7. The rotary flow control device for a container filling system of claim 6 wherein the fill tube and supply hopper have extending therethrough an interrupted screw auger comprising a shaft having affixed thereto an upper section of flights that is disposed entirely within the supply hopper and an lower section of flights that is disposed entirely within the fill tube, the upper and lower sections of flights being separated by a space of predetermined length, the space being generally located at a juncture between the fill tube and the supply hopper.

8. The rotary flow control device for a container filling system of claim 7 wherein the upper section of flights of the interrupted screw auger has a diameter that is larger than the diameter of the lower section of flights thereof, the upper section of flights being positioned to act upon a particulate material contained within the supply hopper so as to move the particulate material toward the fill tube coupled to the supply hopper.

9. The rotary flow control device for a container filling system of claim 1 wherein the fill tube is coupled at an upper end to a supply hopper, the supply hopper having disposed therein a wiper assembly comprising a wiper constructed and arranged to move along an inner surface of the supply hopper so as to prevent the adhesion of a particulate material contained within the supply hopper to the inner surface of the supply hopper.

10. The rotary flow control device for a container filling system of claim 9 wherein the fill tube is coupled at an upper end to a supply hopper, the supply hopper having coupled thereto a vibrating mechanism for vibrating the supply hopper to at least partially fluidize a quantity of particulate material disposed therein.

11. The rotary flow control device for a container filling system of claim 9 wherein the fill tube and supply hopper have extending therethrough an interrupted screw auger comprising a shaft having affixed thereto an upper section of flights that is disposed entirely within the supply hopper and an lower section of flights that is disposed entirely within the fill tube, the upper and lower sections of flights being separated by a space of predetermined length, the space being generally located at a juncture between the fill tube and the supply hopper.

12. An auger feed container filling apparatus comprising:

a supply hopper having an inlet and an outlet;

a fill tube having an upper end and a lower end, the upper end of the fill tube being coupled to the outlet of the supply hopper;

an auger comprising a shaft and at least one section of flights disposed within the fill tube;

a rotary flow control mechanism coupled to the lower end of the fill tube, the rotary flow control mechanism comprising:

a stationary plate coupled fixedly to the lower end of the fill tube, the stationary plate having a plurality of flow openings and a central bore formed therethrough, the flow openings being bounded by and defined at least in part by a plurality of ribs;

a rotary plate coupled to the shaft of the auger such that the rotary plate is positioned adjacent the stationary plate opposite the lower end of the fill tube, the shaft of the auger passing through the central bore of the stationary plate, the rotary plate having formed therethrough a plurality of fill openings, the flow openings being bounded by and defined at least in part by a plurality of ribs, the flow openings of the rotary plate and the stationary plate being constructed and arranged such that as the rotary plate rotates in relation to the stationary plate, the flow openings of the respective plates will at least partially become aligned so as to allow the flow of a particulate material being conveyed by the auger through the respective plates of the rotary flow control device, the action of the auger against the rotary flow control device being such that the particulate material is compacted to a degree that limits the incidence of particulate material from falling from the fill tube when the auger is not operational; and, a bag support and handling mechanism constructed and arranged to support a bag adjacent the rotary flow control device for filling.

13. The auger feed container filling apparatus of claim 12 wherein the auger is an interrupted screw auger comprising a shaft that extends through the supply hopper and fill tube, an upper section of flight disposed entirely within the supply hopper, and a lower section of flights disposed entirely within the fill tube.

14. The auger feed container filling apparatus of claim 12 wherein the at least one section of flights of the auger disposed within the fill tube are spaced away from the rotary flow control device by a predetermined distance.

15. The auger feed container filling apparatus of claim 12 wherein the at least one section of flights of the auger are spaced away from the rotary flow control device by a distance of approximately two inches.

16. The auger feed container filling apparatus of claim 12 wherein the flow openings formed through the stationary plate have an edge profile that is at least partially tapered such that an entry side of the flow openings is larger than an exit side of the flow opening, the taper being sufficient to at least partially compact a particulate material flowing through at least partially aligned flow openings of the stationary and rotary plates.

17. The auger feed container filling apparatus of claim 16 wherein the edge profile of the flow openings of the stationary plate taper approximately 15 degrees from an axis defined by the central axis of the fill tube.

18. The auger feed container filling apparatus of claim 12 wherein as the rotary plate rotates with respect to the stationary plate, the ribs defining the flow openings of the rotary plate will act to shear off particulate material that has flowed through the at least partially aligned flow openings of the stationary and rotary plates.

19. A rotary flow control device for a container filling system comprising:

a stationary plate having a plurality of flow openings formed therethrough, the flow openings being separated by a plurality of ribs, the stationary plate being coupled to a discharge end of a fill tube of the container filling system so as to create a flow obstruction of sufficient magnitude to at least partially compact a particulate material flowing through the fill tube;

a plurality of baffles affixed to an upper surface of the ribs of the stationary plate, said baffles simultaneously compacting and directing the particulate materials into the flow openings of the stationary plate; and, a rotary plate coupled to the container filling system and disposed adjacent the stationary plate and having a plurality of flow openings formed therethrough, the rotary plate being constructed and arranged to rotate with respect to the stationary plate in such a manner that the flow openings formed through the rotary plate periodically come into alignment with the flow openings of the stationary plate, thereby allowing the compacted particulate material to flow through the respective flow openings, the rotation of the rotary plate acting to shear off portions of the particulate material that has flowed through the respective flow openings of the stationary and rotary plates.

20. The rotary flow control device for a container filling system of claim 19 further comprising an auger extending into the fill tube, the auger comprising a shaft and at least one set of flights disposed within the fill tube, the shaft of the auger extending through the stationary plate so that the rotary plate may be coupled to the end thereof.

21. The rotary flow control device for a container filling system of claim 20 wherein the flow openings of the rotary plate are positioned out of alignment with the flow openings of the stationary plate when the auger is stationary.

22. A rotary flow control device for a container filling system comprising:

a stationary plate having a plurality of flow openings formed therethrough, the stationary plate being coupled to a discharge end of a fill tube of the container filling system so as to create a flow obstruction of sufficient magnitude to compact a particulate material flowing through the fill tube; and, a rotary plate rotatably coupled to the stationary plate adjacent the stationary plate, the rotary plate having a plurality of flow openings formed therethrough, the rotary plate being constructed and arranged to rotate with respect to the stationary plate in such a manner that the flow openings formed through the rotary plate periodically come into alignment with the flow openings of the stationary plate, thereby allowing the compacted particulate material to flow through the respective flow openings, the rotation of the rotary plate acting to shear off portions of the particulate material that has flowed through the respective flow openings of the stationary and rotary plates.

23. The rotary flow control device for a container filling system of claim 22 further comprising a drive mechanism operatively coupled to the container filling system so as to rotate the rotary plate with respect to the stationary plate.

24. A rotary flow control device for a container filling system comprising:

a stationary plate having a plurality of flow opening formed therethrough, the stationary plate being coupled to a discharge end of a fill tube of the container filling system so as to create a flow obstruction of sufficient magnitude to compact a particulate material flowing through the fill tube; and, a rotary plate coupled to the container filling system and disposed adjacent the stationary plate and having a plurality of flow openings formed therethrough, the rotary plate being constructed and arranged to rotate with respect to the stationary plate in such a manner that the flow openings formed through the rotary plate periodically come into alignment with the flow openings of the stationary plate, thereby allowing the compacted particulate material to flow through the respective flow openings, the rotation of the rotary plate acting to shear off portions of the particular material that has flowed through the respective flow openings of the stationary and rotary plates.

* * * * *

UNITED STATES PATENT AND TRADEMARK OFFICE

CERTIFICATE OF CORRECTION

PATENT NO. : 6,470,921 B1
DATED : October 29, 2002
INVENTOR(S) : Harold McGregor It is certified that error appears in the above-identified patent and that said Letters Patent is hereby corrected as shown below:

Column 10,
Line 57, after the first occurrence of the word "having" please insert the words -- a plurality --.

Signed and Sealed this

Twenty-fourth Day of June, 2003

JAMES E. ROGAN
*Director of the United States Patent and Trademark Office*